US006764969B1

(12) United States Patent
Kuhn et al.

(10) Patent No.: US 6,764,969 B1
(45) Date of Patent: Jul. 20, 2004

(54) TEXTILE SURFACE COATINGS OF IRON OXIDE AND ALUMINUM OXIDE

(75) Inventors: Hans H. Kuhn, Spartanburg, SC (US); Peter K. Kang, Gainesville, FL (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/281,089

(22) Filed: Mar. 30, 1999

Related U.S. Application Data

(63) Continuation of application No. 09/007,687, filed on Jan. 15, 1998, now Pat. No. 5,928,720.

(51) Int. Cl.[7] ..... B32B 27/04

(52) U.S. Cl. ..... 442/123; 442/63; 442/69; 442/164; 442/168

(58) Field of Search ..... 442/63, 69, 123, 442/164, 168, 118, 394, 395

(56) References Cited

U.S. PATENT DOCUMENTS 4,435,220 A * 3/1984 Watanabe et al. ..... 106/291
4,515,850 A * 5/1985 Ishino et al. ..... 428/225
4,911,957 A * 3/1990 Oishi et al. ..... 427/443.1

* cited by examiner

*Primary Examiner*—Terrel Morris
*Assistant Examiner*—John J. Guarriello
(74) *Attorney, Agent, or Firm*—Terry T. Moyer; Charlotte C. Wilson

(57) ABSTRACT

A textile substrate is provided which is coated with a film comprising iron (III) oxide hydroxide and aluminum oxide hydroxide. This film or coating is formed by contacting the textile substrate with an aqueous solution comprising ferrous or ferric salts and aluminum salts. The iron (II), iron (III), and aluminum ions are hydrolyzed and the iron (II) ions are also oxidized under controlled conditions. These hydrolyzed species then, it is believed, coprecipitate or copolymerized to on the textile surface to form a smooth, coherent, substantially amorphous iron (III) oxide/aluminum oxide hydroxide film or coating on the surface of the substrate without forming an insoluble iron (III) or aluminum hydroxide precipitate in the solution. This is accomplished by controlling the reaction conditions such that the rates of adsorption onto the substrate surface of both iron (III) and aluminum oxide hydroxides are greater than the rates of formation of said same oxide hydroxide particles. The resultant coating is substantially amorphous with extremely limited crystalline formation. The obtained substrate has very good color fastness, bacteriostatic, and virus removing properties and can be utilized as an inexpensive and effective water filtration article.

10 Claims, No Drawings

TEXTILE SURFACE COATINGS OF IRON OXIDE AND ALUMINUM OXIDE

CROSS REFERENCE TO RELATED APPLICATIONS

This application is a continuation of application Ser. No. 09/007,687, filed on Jan. 15, 1998 now U.S. Pat. No. 5,928,720. This parent application is herein entirely incorporated by reference.

FIELD OF THE INVENTION

This invention relates to coatings of iron and aluminum oxides for deposition on textile substrates. This invention also relates to a method for the deposition of iron (III) oxides and aluminum oxides in status nascendi from an aqueous solution of iron (II) or iron (III) and aluminum salts so as to form such a coherent, substantially amorphous textile coating. The present invention further relates to articles produced thereby.

DISCUSSION OF THE PRIOR ART

It has long been known that particulates of iron oxides may be used as pigments to dye substrates. Given the multitude of forms of iron oxides known to exist and the natural abundance of iron, iron oxides can potentially provide an inexpensive, readily available method of coloring certain substrates, such as textiles. However, the use of iron oxide pigments to dye textiles has serious drawbacks. This is largely due to the fact that the pigments comprise a plurality of discrete particles or crystals of various iron oxides which do not bind directly to the fabric. Because of this, a binder must be applied with the pigment to hold the individual pigment particles in place. Furthermore, the particles have a very limited ability to penetrate the interstices of the fabric. Thus, the coloring of textiles with iron oxide pigments is limited to a topical treatment.

In addition to its use as a colorant, particulate iron oxide has been applied to substrates in an attempt to increase their conductivity. For example, U.S. Pat. No. 3,958,066 to Imamura et al. discloses one potential method of binding a metal oxide particle directly to a textile fiber. In this method a fiber, in a heated, softened state, is coated with a metal powder. The fiber is cooled effectively binding the individual metal particles to the fiber and the bound particles are subsequently oxidized to form metal oxides. This method suffers from the requirement of high temperatures in order to soften and necessarily weaken the fiber as well as the inability to form a truly smooth, coherent, uniform coating of metal oxide from the oxidation of individual metal particles.

The prior art suggests iron oxides may be formed in films under certain conditions. For example, an article by Rochelle M. Cornell, "The Film-Forming Abilities of Iron Oxides and Oxyhydroxides," *Clay Minerals*, vol. 18, pp. 209–213 (1983), suggests that under appropriate conditions dispersed synthetic goethite (an iron oxide hydroxide) may form a self-supporting film upon vacuum-filtration and drying. Ferrite films for textiles or fibers are disclosed in U.S. Pat. No. 4,515,850 to Ishino et al. and U.S. Pat. No. 4,911,957 to Oishi et al. However, these films are not produced within the same required pH, temperature, and concentration parameters of the instant invention. In U.S. Pat. No. 4,435,220 to Watanabe et al. transparent, colored pigments are disclosed which are formed by precipitating a mixture of metal oxides, including alkali earth metal oxides, from an aqueous solution and depositing the precipitate of this mixture onto platelet-shaped, inorganic particles, of from 1 to 100 microns in size, formed from materials such as mica, glass, and talc. The precipitation of goethite in crystalline form has also been discussed in a more recent article by Kulamani Parida and Jasobanta Das, "Studies in Ferric Oxide Hydroxides," *Journal of Colloid and Interface Science*, vol. 178, pp. 586–593 (1996). U.S. Pat. Nos. 3,657,003 and 3,767,590, both to Kenney, disclose methods of making non-wettable surfaces wettable in applications such as the printing of electrical circuits. Patentee's method entails first providing a salt solution which produces a colloidal mixture of hydrous oxide particles and subsequently immersing the non-wettable surface in this colloidal mixture, ultimately forming a new wettable surface on top of the non-wettable surface.

There is no teaching within this prior art of a textile coating or film comprised of iron oxide and aluminum oxide. Such a film provides an effective and inexpensive method of providing color to surfaces. This is accomplished through the formation of smooth, durable, substantially amorphous, coherent iron (III) oxide/aluminum oxide films on the surfaces of certain fabric substrates utilizing inexpensive, readily available iron and aluminum salts. Such coatings provide other benefits such as improved color fastness and vastly improved bacteriostatic properties.

SUMMARY OF THE INVENTION

It is thus an object of the present invention to provide a film for fabric surfaces comprising iron oxide and aluminum oxide, as well as a method of producing such smooth, substantially amorphous, coherent coatings. It is another object of the present invention to produce textile composites by this method. Another object of the invention is to color textiles with these coatings. Still another object of the present invention is to provide colored coatings for textiles which are durable, smooth, and coherent. Yet another object of the invention is to apply iron oxide/aluminum oxide coatings to a substrate without subjecting the substrate to damagingly high temperatures and without using binders to adhere the coating to the surface. A further object of this invention is to coat different types of substrates, notably textiles, with such an iron oxide/aluminum oxide film in order to provide vastly improved bacteriostatic properties. Such a coated textile can be utilized in water filtration processes. The utilization of iron (II) and aluminum oxides within such a filtration article provides extremely low toxicity to a consumer since such oxides are already frequently ingested for medicinal purposes (i.e., to increase red blood cell production or as an antacid, respectively).

Accordingly, a method for producing a substrate coating is provided in which a substrate is contacted with a water-based solution containing a dissolved ferrous or ferric salt in addition to an aluminum salt. In order to produce a substantially amorphous coating on the substrate surface an in situ formation of iron and aluminum oxide hydroxide (hydrated forms) articles must first take place. Most important in this in situ formation is that the particles be sub-colloidal in size; they must have a sufficiently small average particle size so as to permit film generation on the surface of the textile. If the average particle size were too large, and if the colloidal particles would pack together, it could effectively prevent the film-forming ability of the metal oxide hydroxides. These necessarily small metal-oxide-hydroxide particles then are adsorbed onto the surface of the substrate. This adsorption is obtained because the rate of reaction of in situ formation of iron oxide and aluminum oxide particles is slower than the rate of adsorption of such particles to the fabric surface. Also, this surface adsorption rate for the oxides is greater than the rate of coagulation between such oxide particles. This can be achieved by maintaining the pH of the water-based solution at about 2.5 or higher, with preferred ranges (up to 8) dependent upon the particular metal oxide films desired, and, at the same time, by heating the solution to a temperature of about 50° C. or higher, again with particular ranges for specific metal oxides. It is believed that the iron (II) salt, when utilized, which dissociates in solution to form the corresponding ion is first hydrolyzed to the soluble iron (II) hydroxide and then oxidized to form iron (III) oxide (actually iron oxide hydroxide). If iron (III) salt is utilized, then the corresponding ion is only hydrolyzed, since it has already been oxidized to the iron (III) state, to form iron (III) oxide (again, actually, iron oxide hydroxide). Although the iron (III) oxide has an extremely slight solubility in water, the conditions of the system such as pH, temperature, and concentrations are controlled such that the iron (III) oxide does not precipitate in solution, but it adsorbs onto the substrate surface, as noted above. In this manner, the iron (III) oxide is not deposited in bulk upon the surface; it is formed in situ and subsequently adsorbed on the surface of the substrate. When the iron (II) oxide is hydrolyzed and oxidized in the presence of the aluminum salt or salts, the same type of reaction is believed to take place. Furthermore, it is suspected that the aluminum oxide hydroxide associates with the iron (III) oxide hydroxide to form some type of coprecipitate or copolymer (see TABLE 4, below). This coprecipitate or copolymer is what forms the extremely uniform and coherent coating on the textile surface. Crystalline formation from this coating process is virtually nonexistent.

Besides meeting the above objectives, the present invention, in its preferred embodiments, contains one or more of the following features:

- the solution additionally contains an acid neutralizer (base), preferably urea, which releases ammonia in water-based solution at elevated temperatures;
- the initial iron (II) salt is Mohr's salt;
- the initial aluminum salt is aluminum sulfate;
- the solution also contains a buffer system, such as formic acid and ammonium formate, to control the pH of the solution;
- the solution also contains a dispersing agent;
- the iron (III) oxide component of the coating is preferably goethite ($\alpha$-FeOOH) in a substantially pure form;
- the textile is formed from either natural, inorganic or synthetic fibers, including polyester and polyamides, such as nylon;
- the weight added on to the substrate by the iron (III) oxide/aluminum oxide coating is within the range of from about 0.1 to about 5% of the weight of the fabric (owf), preferably from about 0.3 to about 3% owf;
- the iron (III) oxide/aluminum oxide coating can be applied without weakening or softening the substrate, preferentially at temperatures of 100° C. or less; and
- the range by weight ratios of iron (III) oxide to aluminum oxide present within the coating is 30:1 to 1:2, and most preferably 20:1 to 2:1.

DETAILED DESCRIPTION OF THE INVENTION

Without limiting the scope of the invention, the preferred embodiments and features are hereinafter set forth. Unless otherwise indicated, the terms "coprecipitate" and "copolymer" are used broadly to denote the film comprising the combination of iron (III) oxide hydroxide and aluminum oxide hydroxide. Also, unless otherwise indicated, percentages are by weight, the temperature is 90° C., and the pressure of the system is from 1 to 3 atmospheres. Unless otherwise indicated, the term "iron oxides" is used broadly to denote compounds containing combinations of either iron and oxygen or iron, oxygen, and hydrogen. This includes compounds containing only iron and oxygen, i.e. iron oxides in the narrow sense; compounds containing iron and hydroxide groups, i.e. iron hydroxides; and compounds containing iron with combinations of oxygen and hydroxide groups, i.e. iron oxide hydroxides. The same holds true for the term "aluminum oxides." Some examples of such iron oxide compounds are goethite, hematite, lepidocrocite, magnetite, akaganeite, schwertmannite, ferrihydrite, bernalite, maghemite, and wustite. Further examples can be found in the article "Iron Compounds," *Kirk-Othmer Encyclopedia of Chemical Technology*, 4th edition, under the subheading "Oxides and Hydroxides" at pp. 883–884, the teachings of which are incorporated by reference. An example of such an aluminum oxide compound is gibbsite.

As used herein, the term "ferrous" describes compounds containing iron in its 2+ oxidation state. As used herein, the term "ferric" describes compounds containing iron in its 3+ oxidation state. Aluminum salts are also present in the 3+ oxidation state.

Other than in the operating examples or where otherwise indicated, all numbers expressing quantities of ingredients or reaction conditions used herein are to be understood as modified in all instances by the term "about." Furthermore, all weight percent amounts are impliedly referring to weight percent of the substrate, unless otherwise indicated.

All of the United States patents and other publications cited within this Specification are incorporated herein by reference.

The different substrates preferred within this invention include textiles, yarns and fibers preferably wherein the textile is in fabric form.

Also, the aluminum oxide formed is preferably gibbsite.

A textile composite formed according to the present invention comprises a textile substrate onto which a smooth, coherent coating of one or more iron (III) oxides coprecipitated or copolymerized with aluminum oxide has been deposited. This deposition occurs through the hydrolysis and oxidation of iron (II) ions, if an iron (II) salt is utilized, or the hydrolysis of iron (III) ions, if an iron (III) salt is utilized, either of which are in aqueous solution. In either procedure, iron (III) oxide (hydroxides) are formed according to this invention under reaction conditions such that iron (III) oxide (hydroxide), in status nascendi, is nucleated in situ on the surface of the textile without precipitation of the iron (III) oxide (hydroxide) within the solution in appreciable quantities all in the presence of an aluminum salt. The aluminum salt undergoes the same type of hydrolysis to form ultimately particles of aluminum oxide (hydroxide). There are some instances also where the precipitates of both iron (III) oxide and aluminum oxide are of colloidal sizes. This is controlled through the utilization of the specific method of the instant invention. Careful adjustments within the pH, temperature, and concentration parameters herein disclosed should provide a solution wherein the average oxide particle size is low enough to effectuate the desired formation of iron-aluminum-oxide hydroxide film.

The textile substrate employed comprises fibers in the form of yams, including those in staple, spun, or continuous multifilament form, or it may be in the form of a fabric. Preferably the textile is in fabric form. This fabric is of woven, knit, or non-woven construction, and is preferably woven.

A wide variety of natural, synthetic, and inorganic fibers may be used in the textile. The main problem with such fibers is that they must be able to withstand processes utilizing large amounts of water. The melt properties of the fiber are in general not an obstacle since the coating is deposited at temperatures of about 100° C. or less and the softening of the fiber with increased temperatures is unnecessary in order for the coating to adhere. Thus, any fiber material which is not damaged by the presence of water or by temperatures of about 100° C. is usable. By way of example, the following materials may be employed: polyamides, including nylon, such as nylon 6 and nylon 6,6 and aramids; polyesters, such as polyethylene terephthalate (PET); acrylics; and cellulosic materials, such as cotton, rayon, and acetate; and inorganic fibers, such as aluminum oxide fibers or boron-derived fibers. Preferably the substrate is a textile is selected from polyesters or polyamides, most preferably from polyester fibers.

A wide range of fabric weights and deniers may be employed; however, fabrics weighing 1 to 20 oz/yd$^2$, preferably 2 to 10 oz/yd$^2$, may be employed. Knit and woven fabrics may be constructed from staple and continuous filament yarn, such as yarn having a denier of 0.5 to 30, preferably 0.5 to 5.

A coherent iron oxide/aluminum oxide film is deposited on the textile by hydrolysis and oxidation of iron (II) or hydrolysis of iron (III) in an aqueous solution in the presence of an aluminum salt which is then contacted with the textile. The amount of solution used is based on the weight ratio of the solution to the textile to be coated. The ratio of textile to solution may range from 1:3 to 1:50, preferably 1:8 to 1:30, and most preferably 1:10 to 1:20.

Virtually any water-soluble iron (II) salt may be utilized to produce this solution. By way of example, iron sulfate, iron chloride, iron bromide, iron iodide, Mohr's salt, iron acetate, and any mixtures thereof may be utilized. In one preferred embodiment of the present invention, Mohr's salt, a ferrous salt having the formula $Fe(NH_4)_2(SO_4)_2.6H_2O$, is utilized.

Virtually any water-soluble aluminum salt may be utilized also. Examples include aluminum sulfate, aluminum chloride, aluminum bromide, aluminum iodide, aluminum ammonium sulfate, aluminum nitrate, aluminum fluoride, and water-soluble aluminum acetates. Mixtures of any of these salts are also contemplated. Preferred is aluminum sulfate.

The concentration of the iron (II) or iron (III) ions present in the solution, expressed as the weight percent of such ions may range from 0.1 to 10, preferably from 0.5 to 5 and most preferably from 0.5 to 2. The aluminum salt is added in ratios of from 1:99 to 1:1 of the total amount of the iron (II) or (III) salt. Preferably, the entire amount of salt in the aqueous solution is 50–99% iron (II) or (III) salt and 1–50% aluminum salt, all expressed in weight percent. More preferred is 70–95% iron (II) or (III) and 5–30% aluminum. Most preferred is 90% iron (II) and 10% aluminum. The resultant range of ratios by weight of the iron (III) oxide (hydroxide) and aluminum oxide (hydroxide) within the coprecipitate or copolymer coating is 30:1 to 1:2, preferably 20:1 to 2:1, and most preferably 20:1.

In one preferred embodiment of the present invention the aqueous solution also comprises a compound which releases ammonia in aqueous solution. Examples of such compounds include urea, formamide, and acetamide. This ammonia-producing compound is present in solution in a concentration range from 1 to 30 g/L. Preferably, the compound employed is urea at a concentration of from 1 to 30 g/L and ideally 2 to 15 g/L.

In another preferred embodiment of the present invention the aqueous solution additionally comprises a dispersing agent. Although its role in the formation of the coating is not completely understood, it has been found to increase the yield and uniformity of the coating process. Suitable examples of ionic dispersing agents include sulfonated organic compounds. Preferably the dispersing agent is a sulfonated alkyl naphthalene, such as Rhodacal BX-78™ available from Rhône-Poulenc. The dispersing agent is used in the solution at a concentration of from 0.1 to 5 g/L and is preferably from 0.3 to 0.8 g/L.

In another preferred embodiment of the invention, the solution additionally comprises a buffer system for regulation of the solution pH. The buffering system comprises a weak acid together with a water-soluble salt whose anion is the weak acid's conjugate base. Such buffering systems are well-known to those skilled in the art and may include acetic acid/sodium acetate, formic acid/ammonium formate, and acetic acid/ammonium acetate. Preferably the buffering system comprises formic acid/ammonium formate. The concentrations of the weak acid and salt containing its conjugate base will vary depending on the final pH at which the solution is to be buffered. In general these concentrations will each range from 0.5% to 10% weight percent of the solution. The exact concentrations needed to achieve a given pH can be calculated by methods which will be appreciated by those of ordinary skill in the art.

The resultant iron oxide/aluminum oxide coprecipitate or copolymer coating comprises one or more forms of iron (III) oxide (hydroxide) which is nucleated in situ on the surface of the substrate. This process differs from prior art teachings in which iron (II) ions are subjected to strong oxidation conditions under which a large part of the iron (II) is oxidized to iron (III). The iron (III) ions then form significant amounts of iron (III) oxide in solution which precipitates out, in effect clouding the solution. In contrast, the process of the present invention involves the careful control of solution variables such as temperature, pH, and concentration so that iron (III) oxides do not actually precipitate, but iron (III) oxides are only formed in situ, adsorbed to the surface of the textile, and deposited thereon in status nascendi all in the presence of aluminum salt or salts, which undergoes the same type of hydrolysis and deposition as the iron species. With proper selection of the reaction conditions, the substrate is coated without ever causing haziness or clouding in the solution due to the precipitation of iron (III) oxides in solution.

A number of types of iron (III) oxides (again, actually, iron oxide hydroxides) may be coprecipitated or copolymerized with aluminum oxide (hydroxide, also) and deposited on the substrate by the process of the present invention. By way of example only, the coating may comprise goethite, lepidocrocite, hematite, magnetite, or a combination of these forms. Certain iron oxide forms produce certain colors on and lend other characteristics to the composite. Potentially, if small amounts of other metal oxides are present on the textile surface, they may also modify the color produced or properties obtained.

The surface of the coating deposited by the present invention has been found to have good qualities of smoothness, coherence, and uniformity. By "uniformity" it is meant that the thickness of the coating formed does not vary significantly from area to area on the textile surface. Coherence means that the film coating formed is substantially continuous without significant areas of the surface left uncoated. No crystalline formations have been found on the surface subsequent to the coating of the textile; the resultant coprecipitate or copolymer film is deposited on the substrate in an essentially amorphous state. This smooth, substantially amorphous coating is prevalent in this process and is not readily present on textiles colored with purely iron (III) oxide films.

The thickness and add-on weight of the coating formed may vary considerably. The thickness may range from 0.01 to 2 microns and is preferably from 0.01 to 0.5 microns. The add-on weight as a percentage of the textile weight ranges from 0.2 to 5 and is preferably from about 1 to about 2 percent.

As noted above, reaction conditions such as temperature and pH are carefully controlled to form a smooth, coherent coating of iron (III) oxide/aluminum oxide film in the present invention. The temperature to which the aqueous solution is heated can vary but is in the range of about 60° C. to about 100° C. Preferably the temperature is about 70° C. to about 95° C. and more preferably about 80° C. to about 95° C. Likewise the exact pH may vary, but it has been found that the pH must be about 2.5 and is preferably greater. For example, a goethite/aluminum oxide hydroxide coating is formed in the pH range of about 2.5 to about 4.5.

Under certain conditions, the surface may additionally comprise esters of the acids present in the reaction mixture such as hydroxysulfate esters. The type of ester present will vary with the type and concentration of the acid species in solution.

The time necessary for the deposition of the coating onto the substrate surface depends on the thickness desired and the reaction conditions, i.e. temperature, pH, and concentrations, used. In general, the solution is contacted with the substrate at reaction conditions for 1 to 4 hours, preferably 1.5 to 2.5 hours.

In a preferred embodiment of the present invention, the coated substrate is rinsed with clean water and then dried.

As previously noted, it is suspected that the coating obtained is actually a coprecipitate or copolymer of iron (III) oxide hydroxide and aluminum oxide hydroxide. One method of testing the film for its content is to wash a coated sample of fabric with a 0.1M KOH which results in the removal by dissolution of aluminum hydroxide but leaves the copolymer unaffected. Examining the extracted liquor for its atomic emission spectrum determines the amount of the non-copolymerized aluminum hydroxide, whereas the aluminum detected on the extracted fabric by X-ray fluorescence indicates the degree aluminum has been copolymerized with the iron oxide formed. The procedures and results of this testing are found below in TABLE 4.

Also, the determination of which type or types of iron oxides are present was attempted using X-ray diffraction techniques. However, no formation of crystalline material occurred. Thus analysis by conventional X-ray diffraction techniques was not possible. Other analytical data may be obtained by X-ray fluorescent measurements of the coated fabric to detect, for instance, the presence of aluminum, as mentioned above, and the formation of sulfate or other esters. Furthermore, analysis of the infrared spectra of the coated fabric can also be helpful in the determination of certain oxides.

The method of the present invention and products formed thereby find a utility in a multitude of applications. As previously discussed, the coatings of the present invention have distinct color shades based on the iron oxide and aluminum oxide present in the coating. These colors actually appear from pale to darker yellow, and particularly, exhibit color altering abilities with the goethite component such that a pastel yellow shade is produced from a combination of aluminum and pure goethite (which alone forms a darker yellow color). Such a specific material change in color properties, to pastel hues, is unexpected upon the introduction of such a coprecipitate or copolymer comprising the aluminum oxide and iron oxide. These properties, combined with the excellent light fastness of the coatings, allow for the beneficial utilization of the present invention for the dyeing or coloring of the aforementioned textiles. Furthermore, as mentioned above, the nontoxic and benign character of the chemicals used (iron and aluminum oxide) provide an acceptable article for water filtration applications.

Most significant to this invention are the improved bacteriostatic and virus removal properties obtained by these inventive textile surface coatings. These properties are noticeably better than with iron (III) oxide coatings alone and are comparable to other standard, more expensive, bacteriostatic treatments. The relative inexpensive ingredients and machinery needed to produce this invention thus provide a noticeable improvement over the prior art. Because of the effective bacteriostatic and virus removal properties obtained by such a coated substrate, water filtration applications are contemplated within this invention. These characteristics are explained and such data are presented in tabular form below.

Another use of the present invention is to improve the wicking and hydrophilic properties of normally hydrophobic materials such as polyester. It has been found that the deposition of iron oxide on the surface of textiles changes their surface characteristics quite dramatically. It is known that the surface free energy of iron oxides such as goethite and hematite is quite high as compared to that of hydrophobic textile surfaces formed from synthetic fibers. Textile surfaces treated with the iron oxide/aluminum oxide coating also shows improved wetting characteristics with high surface tension liquids such as water. This is particularly beneficial in filtration applications and other end uses where wetting is desirable.

Still another use of the present invention is to provide a textile with an inorganic surface coating which can be further reacted with ionic species including but not limited to sulfates and phosphates. The present invention may also be utilized for providing media to polish metals. Yet another use of the present invention is to provide textile or polymeric substrates with magnetic properties.

Furthermore, other salts of metals may be utilized, such as manganese, chromium, and magnesium, to name just a few available cations, to form amorphous iron (III) oxide copolymers on substrates in addition to or in place of the aluminum salt.

PREFERRED EMBODIMENT OF THE INVENTION

The general method utilized was as follows:

Approximately 100 g of fabric was placed in a Werner Mathis JF dyeing machine having a rotating basket insert and a liquid capacity of approximately 3 liters. The chemicals used were separately mixed in a beaker with water. The total volume of water and chemicals was 2 liters. This mixture of chemicals was then introduced through an addition tank into the aforementioned dyeing machine. The rate of agitation was set at approximately 60 turns per minute with an interrupted clockwise and counter clockwise turning mode. The reaction temperature was set at the desired level and heating occurred at maximum rate until the final temperature was reached. Unless otherwise indicated, the reaction continued for two hours at the desired temperature. After this time, the machine was set on automatic cooling and the liquor was decanted when the temperature reached approximately 50° C. The fabric was washed three times with water and then withdrawn from the machine and air dried.

Unless otherwise stated, a polyester fabric consisting of a 2×2 right-hand twill, weighing approximately 6.6 ounces per square yard and being constructed from a 2/150/34 textured polyester yarn Type 667 from Wellman Inc. was utilized. The fabric construction was approximately 70 ends per inch in the warp direction and 55 picks per inch in the fill direction.

A polyester fabric consisting of a 2×2 right-hand twill, weighing approximately 5.5 ounces per square yard and being constructed from a microdenier 1/140/200 textured polyester yarn Type 56T Dacron® from DuPont in the warp direction and a microdenier 1/150/100 textured polyester yarn Type 56T Dacron® from DuPont in the filling direction was also tested. The fabric construction was approximately 173 picks in the filling direction and 74 ends in the warp direction. This fabric having a very high surface area was selected because of its potential as a filter. Fabrics different from the above polyester fabrics were obtained from Testfabrics Inc. in Middlesex, N.J. and reported under their style number. All of the fabrics used were scoured with a scouring agent, preferably Rhodacal BX-78™ (a product of Rhône-Poulenc), prior to use.

EXAMPLE 1

This example shows a typical recipe for the deposition of goethite on a regular textured polyester fabric. A solution was prepared using 15 g of Mohr's salt with the formulation $(NH_4)_2Fe(SO_4)_2.6H_2O$ in approximately one liter of water. Separately, a solution of 1.32 g of ammonium formate, 1 g of formic acid, 1.2 g of Rhodacal BX-78™ (a product of Rhône Poulenc), and 10 g urea was dissolved in another 1 liter of water. The two solutions were combined by adding the second solution to the first. The pH of the solution was 3.6. The solution was added to the dye machine as described above and heated at 90° C. for two hours. At this time, the pH of the solution was 3.6 and, after drying, the fabric showed a pickup of about 1.5 g. The resultant color was a bright yellow.

EXAMPLE 2

The procedure from Example 1was repeated except that in addition to 15 g of Mohr's salt, 3.75 g of aluminum sulfate $Al_2(SO_4)_3.18H_2O$, 10 g of urea, 2.5 g of concentrated formic 2.64 g of ammonium formate, and 1.2 g of Rhodacal BX-78™ were used. The pH of the solution remained at about 3.1 or 3.2 and the liquid stayed clear through the entire reaction. The dried fabric showed a pale yellow color and a weight increase of approximately 2 g. The liquor was analyzed during the reaction by the atomic emission spectrum and it was determined that 564 milligrams of iron and 228 milligrams of aluminum disappeared from the solution and deposited as a coherent film in the form of oxide hydroxides on the surface of the fabrics.

EXAMPLE 3

Example 2 was repeated except that no fabric was added to the dye machine. As the reaction progressed, a pale yellow precipitate was formed in the liquor. The liquor became more and more cloudy as time progressed. After the 2-hour reaction time, the contents of the dye machine was transferred into a 3-liter beaker and left standing overnight. The clear liquor was decanted and the residual powder was filtered through a Buchner funnel, washed with water, collected in a Petri dish and dried, and 1.66 g of a powder was obtained. Atomic emission spectrum of the original solution and the final solution indicated that 587 milligrams of iron and 227 milligrams of aluminum disappeared from the solution and precipitated in the form of iron-aluminum-oxide hydroxide particles. These amounts showed an excellent correlation between the deposition on textiles and the precipitation as powder. X-ray diffraction analysis showed that the powder is totally amorphous and has no peak indicating the presence of any crystalline material.

EXAMPLE 4

Example 2 was repeated except that the fabric now was made from microdenier polyester fibers. The pH this time changed from 3.4 to 3.3 and the fabric showed a pale yellow color after drying. A pickup of 2.2 g was determined by weight. An atomic emission spectrum indicated that 612 milligrams of iron and 307 milligrams of aluminum disappeared from the liquor and deposited on the surface of the fabric in form of a coating of iron-aluminum-oxide hydroxide.

EXAMPLE 5

Example 4 was repeated using the same microdenier polyester fabric except that this time 30 g of urea, 1 g of concentrated formic acid, 2.6 g of ammonium formate and 1.2 g of Rhodacal BX-78™ were added to the iron and aluminum salts. Under these conditions the pH was slightly higher and changed from 3.6 to 4.3 which resulted in an increased amount of hydrolyzed iron and aluminum. Indeed the fabric showed a pickup of 2.9 g and the atomic emission spectrum indicated that 1376 milligrams of iron and 315 milligrams of aluminum disappeared from the solution and deposited on the surface of the fabric in the form of a coating of iron-aluminum-oxide hydroxide.

EXAMPLE 6

Example 1was repeated using regular polyester fabric and only 15 g of aluminum sulfate, 30 g of urea, 1 g of concentrated formic acid, 2.64 g of ammonium formate and 1.2 g Rhodacal BX-78™. The pH changed from 3.3 to 3.4 and the liquor stayed clear during the reaction. The fabric obtained was white and showed an increase of 1.4 g. This Example showed that aluminum hydroxide can be absorbed by this method to the surface of a polyester fabric.

EXAMPLE 7

Example 6 was repeated except that now the microdenier polyester fabric was used. The ingredients remained the same but the pH of the solution changed from 3.5 to 3.3. The fabric was white after drying and showed a weight gain of 1.7 g.

EXAMPLES 8

Example 2 was repeated except that 15 grams of Mohr's salt and 10.2 g of aluminum sulfate was used with 30 g of urea, 1 g of concentrated formic acid, 2.6 g of ammonium formate and 1.2 g of Rhodacal BX-78™ was also added. The pH changed from 3.5 to 3.8 and a very pale yellow fabric was obtained showing a weight increase of 3.2 g. Atomic emission spectrum indicated that 536 milligrams of iron and 872 milligrams of aluminum disappeared from the solution and deposited on the surface of the fabric in the form of an iron-aluminum-oxide hydroxide film.

Wicking Characteristics

The water wicking characteristics each of the above exemplified treated fabrics were determined by placing a drop of water on the surface of the textile and determining its rate of disappearance. All samples containing a coating of iron and aluminum showed instant wicking of the water drop. Contrary to these findings, the fabrics containing only the hydrolysis product of aluminum sulfate show slow or no wicking into the fabric.

Bacteriostatic Characteristics

A. Bacterial Removal Efficiency

In a water filtration application, the rate of bacteria removal by the iron-aluminum-oxide hydroxide coating was measured. Two types of bacteria were used in this experiment: *Staphylococcus aureus* (ATCC 12600), which were spherical, non-motile, gram-positive organisms; and *Escherichia coli* (ATCC 15597), which were cylindrical, motile, and gram-negative. The bacteria were introduced into a supply of water at concentrations of $1.9\times10^5$ CFU/milliliter for *S. aureus* and $5.5\times10^5$ CFU/milliliter for *E. coli*. These concentrations were measured by the spread plate method described in Gerhardt, Philipp et al., *Methods for General and Molecular Bacteriology*, American Society for Microbiology, p. 254–57 (1994), using Mannitol Salt Agar for *S. Aureus* and MacConkey Agar for *E. Coli*. The filter was made from the materials listed below in Table 1. The filtration procedure was performed at a pH of 7 and at a water flowrate of 10 milliliters per minute through two 25 mm diameter stainless steel filter holders connected in series. Each filter holder contained four layers of the respective sample material. The results were tabulated as follows:

TABLE 1

Bacterial Removal Efficiency

| Material | *S.aureus* Removal (%) | *E.coli* Removal (%) |
|---|---|---|
| Uncoated Polyester Fabric (Control) | 7.9 | 13.5 |
| Uncoated Microdenier Polyester Fabric (Control) | 45.0 | 21.2 |
| Fabric From Example 2 Above (Coated Polyester) | 94.2 | 88.4 |
| Fabric From Example 5 Above (Coated Microdenier Polyester) | 84.9 | 59.1 |
| Fabric From Example 7 Above [$Al(OH)_3$ Coated Microdenier] | 60.5 | 47.0 |
| Fabric From Example 8 Above (Coated Polyester) | 77.7 | 63.0 |

The measured efficiency of each material was the result of the comparison of the pre-filtered initial concentration and post-filtered reduced concentration of each bacterium. The coated substrates show significant increases in filtration and bacterial removal efficiency as compared to the uncoated samples.

B. Antibacterial Activity by the Parallel Streak Method

A further method followed to assess the antibacterial activity of the iron-aluminum-oxide hydroxide copolymer coated textiles is a procedure described by AATCC Test Method 147–1997, "Antibacterial Activity Assessment of Textile Materials: Parallel Streak Method." In this test, fabric samples were placed in contact with nutrient agar which has been streaked with the bacteria specimen, in this case *Staphylococcus aureus*. The bacteria were then incubated and the resultant fabric samples were examined for bacteria growth. If a clear area of interrupted growth underneath and along the sides of the test material is noticed then antibacterial activity is indicated. There are other degrees of such antibacterial activity which are rated below:

4—clear area around the fabric strip (excellent antibacterial activity)

3—grows to the edge but not underneath the fabric strip (good antibacterial activity)

2—detectable growths underneath the fabric strip (fair antibacterial activity)

1—no inhibition of growth (poor antibacterial activity)

A new example, Example 2A below, was prepared utilizing the same procedure as in Example 2 above except that only 1.43 g of aluminum sulfate, 1.0 g of formic acid, and 30 g of urea were used. The pH level of the solution was initially 3.9 and ultimately was measured at a level of 4.4. The liquid remained clear throughout the entire reaction. The dried fabric showed a yellow color and had a weight increase of about 2 grams. The liquor was analyzed during the reaction by measuring its atomic absorption spectrum. This measurement indicated that 1517 milligrams of iron and 94 milligrams of aluminum, in the form of their respective oxide hydroxides, disappeared from the solution and deposited upon the surface of the fabric as a coherent film. The test results are summarized in TABLE 2:

TABLE 2

Antibacterial Activity by the Parallel Streak Method

| Material | RATING | | |
|---|---|---|---|
| | As Received | After 1 Wash | After 5 Washes |
| Fabric From Recipe of Example 1 Above | 1 | 4 | 2 |
| Fabric From Recipe of Example 2 Above | 3 | 3 | 4 |
| Fabric From Example 2A | 1 | 4 | 4 |
| Fabric From Recipe of Example 6 Above | 0/1 | 0/1 | 3 |

Again, this test shows the antibacterial activity available from such a fabric coating as the iron-aluminum-oxide hydroxide coating of this invention.

Virus Removal Characteristics

In a water filtration application, the rate of virus removal by the iron-aluminum-oxide hydroxide coating was measured. Three types of viruses or bacteriophages were used in this experiment: PRD-1, at an initial concentration of $3.8\times10^6$PFU/milliliter; MS2, at an initial concentration of $1.7\times10^5$ PFU/milliliter; and ΦX-174, at an initial concentration of $1.8\times10^4$ PFU/milliliter. The filter was made from the materials listed below in TABLE 3 and the filtration procedure was performed in the same manner as for the samples in TABLE 1 above. The specimens were assayed immediately after filtration using the soft agar overlay method described in Snustad, D. P. and Dean, D. S., *Genetic Experiments with Bacterial Viruses*, W. H. Freeman and Co., pp. 1–2 (1971) for comparisons. The results were tabulated as follows:

TABLE 3

Virus Removal Efficiency

| Material | PRD-1 (%) | MS2 (%) | ΦX-174 (%) |
|---|---|---|---|
| Uncoated Polyester Fabric (Control) | 10.6 | 3.7 | 24.8 |
| Uncoated Microdenier Polyester Fabric (Control) | 14.0 | 17.5 | 4.4 |
| Fabric From Example 2 Above (Coated Polyester) | 72.5 | 43.1 | 74.4 |
| Fabric From Example 5 Above (Coated Microdenier Polyester) | 60.5 | 31.4 | 74.6 |
| Fabric From Example 7 Above [$Al(OH)_3$ Coated Microdenier] | 61.3 | 87.1 | 45.6 |
| Fabric From Example 8 Above (Coated Polyester) | 47.3 | 70.7 | 44.4 |

The efficiency was the result of the comparison of the pre-filtered initial concentration and post-filtered reduced concentration of each virus or bacteriophage. The copolymer-coated substrates show significant increases in filtration and virus or bacteriophage removal efficiency as compared to the uncoated samples.

Amount of Possible Copolymer Determination

As noted above, it is suspected that the textile surface coating of iron and aluminum oxide hydroxide formed by the present inventive method comprises a copolymer of the two metal oxides. Such copolymers exist and, generally, are measurable by the amount of aluminum oxide not removed by a 0.1 M KOH washing of the coated substrate. The aluminum may be deposited as aluminum oxide or aluminum oxide hydroxide. In a copolymer, free aluminum hydroxide will easily be dissolved by the KOH wash. If, after extraction, aluminum is found on the textile surface, it is generally accepted that a copolymer of the iron and aluminum oxide hydroxides had formed.

Another new example, Example 2B, was prepared utilizing the same procedure as in Example 2 above except that only 1.43 g of aluminum sulfate, 1.0 g of formic acid, and 30 g of urea were used. The pH level of the solution was initially 3.8 and ultimately was measured at a level of 3.6. The liquid remained clear throughout the entire reaction. The dried fabric showed a yellow color and had a weight increase of about 2 grams. The liquor was analyzed during the reaction by measuring its atomic absorption spectrum. This measurement indicated that 701 milligrams of iron and 96 milligrams of aluminum disappeared from the solution and deposited upon the surface of the fabric as a coherent film. Furthermore, a new composite produced following the recipe of Example 2 was tested. The only difference was in the pH level of the reaction composition which was now between 3.3 and 3.4.

Each of the resultant coated textiles showed the presence of aluminum on the fabric by X-ray fluorescence. At room temperature the samples were washed for about 10 minutes with a 0.1 M KOH solution (1.2 g of KOH dissolved in 2 L of water). After rinsing, the extract liquor was tested for its atomic emission spectrum, particularly in view of its potential aluminum content. The results were as follows:

TABLE 4

Atomic Emission Data for Extract Liquor

| Example | Fe Initially on Fabric | Al Initially on Fabric | Fe in Extract | Al in Extract |
|---|---|---|---|---|
| 2 | 490 mg | 221 mg | <8 mg | 108 mg |
| 2B | 701 mg | 96 mg | <8 mg | 36.5 mg |

From this data, since some, but less than half, of the aluminum deposited on the textile surface was extracted, it is strongly believed that some iron oxide/aluminum oxide hydroxide copolymer was formed on the textile surface. This data was further supported by the detection of considerable amounts of aluminum on the textile through the use of X-ray fluorescence.

Furthermore, one final test was performed merely weighing the fabric before and after washing with KOH. The change in weight of the sample was minimal, coinciding roughly with the loss of aluminum as determined using the atomic emission spectrum data.

There are, of course, many alternative embodiments and modifications of the present invention, which are intended to be included within the spirit and scope of the following claims.

What is claimed is:

1. A textile coated with a film comprising an amorphous coprecipitate of iron oxide hydroxide and aluminum oxide hydroxide.

2. The textile of claim 1 wherein the iron oxide hydroxide within said amorphous coprecipitate is comprised of a majority of goethite.

3. The textile of claim 2 wherein the coating comprises goethite and aluminum oxide hydroxide in a range of ratios by weight of from 30:1 to 1:1.

4. The textile of claim 1 wherein the coprecipitate comprises iron (III) oxide hydroxide and aluminum oxide hydroxide in a range of ratios by weight of from 20:1 to 2:1.

5. The textile of claim 4 wherein the coprecipitate comprises iron (III) oxide hydroxide and aluminum oxide hydroxide in a ratio by weight of 20:1.

6. A textile coated with a film comprising an amorphous copolymer of iron oxide hydroxide and aluminum oxide hydroxide monomers.

7. The textile of claim 6 wherein the iron oxide hydroxide within said amorphous copolymer is comprised of a majority of goethite.

8. The textile of claim 7 wherein the copolymer comprises goethite and aluminum oxide hydroxide in a range of ratios by weight of from 30:1 to 1:1.

9. The textile of claim 6 wherein the copolymer comprises iron (III) oxide hydroxide and aluminum oxide hydroxide in a range of ratios by weight of from 20:1 to 2:1.

10. The textile of claim 9 wherein the copolymer comprises iron (III) oxide hydroxide and aluminum oxide hydroxide in a ratio by weight of 20:1.

* * * * *